US005808526A

United States Patent [19]

Kaegebein

[11] Patent Number: 5,808,526

[45] Date of Patent: Sep. 15, 1998

[54] COMB-LINE FILTER

[75] Inventor: Daniel P. Kaegebein, Depew, N.Y.

[73] Assignee: Tx Rx Systems Inc., Angola, N.Y.

[21] Appl. No.: 812,113

[22] Filed: Mar. 5, 1997

[51] Int. Cl.[6] ..... H01P 1/205

[52] U.S. Cl. ..... 333/202; 333/203

[58] Field of Search ..... 333/202, 203, 333/205, 204, 212, 230

[56] References Cited

U.S. PATENT DOCUMENTS

| | | | |
|---|---|---|---|
| 3,693,115 | 9/1972 | Edson | 333/203 |
| 3,737,801 | 6/1973 | Adams et al. | 331/53 |
| 4,596,969 | 6/1986 | Jachowski | 333/203 |
| 4,875,019 | 10/1989 | Monson et al. | 330/302 |
| 5,051,714 | 9/1991 | Bentivenga et al. | 333/227 |
| 5,373,270 | 12/1994 | Blair et al. | 333/202 |
| 5,410,284 | 4/1995 | Jachowski | 333/203 X |
| 5,446,729 | 8/1995 | Jachowski | 310/37 |
| 5,543,758 | 8/1996 | Wey | 333/203 |

FOREIGN PATENT DOCUMENTS

| | | | |
|---|---|---|---|
| 54-20638 | 2/1979 | Japan | 333/203 |
| 0075902 | 5/1983 | Japan | 333/203 |
| 1191984 | 5/1970 | United Kingdom | 333/203 |

OTHER PUBLICATIONS

G. Matthaei, et al "Microwave Filters, Impedance—Matching Network and Coupling Structures", pp. 500, 501, 614, 615, and 626, 1964.

*Primary Examiner*—Seungsook Ham
*Attorney, Agent, or Firm*—Bean, Kauffman & Snyder

[57] ABSTRACT

A comb-line filter incorporating a plurality of bandpass resonators set off center between ground planes is provided with input and output coupling means comprised of dual notching resonators.

16 Claims, 3 Drawing Sheets

COMB-LINE FILTER

FIELD OF THE INVENTION

The present invention relates to comb-line filters provided with notch resonators in the input and output coupling means.

BACKGROUND OF THE INVENTION

It has long been a practice to utilize a notch resonator in the input and output coupling of a comb-line filter. Such prior art devices rely generally on short resonators with excessive capacitance to the ground planes and one another.

Coupling between the resonators of such a device is achieved between resonators, which are less than a quarter-wave length long at resonance, by electromagnetic fringing fields. The electrical properties are provided by structure which includes rod diameters and spacing and lumped capacitances that prevent the resonators from being a full quarter-wave length long at resonance. If the resonators were a quarter-wave length, the structure would have no bandpass because without reactive loading at the ends of the resonator elements, the electromagnetic coupling effects cancel.

Because of the variety of coupling sets involved in the fringing fields, equating the performance of comb-line filters to mathematical models is so unwieldy that creating a structure having a predetermined response cannot be accomplished by a simple analysis of the structure.

OBJECTIVES OF THE INVENTION

It is a primary objective of the present invention to provide a comb-line filter with dual notch resonator inputs and outputs arranged such that the individual notch resonators will not couple to one another.

Another objective of the present invention is to provide a comb-line filter which may be set to a plurality of individual notch frequencies to enhance the roll off above and below the pass band.

Another objective of the present invention is to provide a comb-line filter with integral notch filters that is more cost effective than combining a plurality of external notch filters.

Another objective of the present invention is to provide a comb-line filter which is easy to tune and match impedances in the bandpass.

A further objective of the invention is to provide a comb-line filter with a plurality of bandpass resonators.

A still further objective of the invention is to provide a comb-line filter wherein bandpass resonators are physically staggered about the center line to reduce mutual coupling between bandpass resonators without lengthening the comb-line chassis.

SUMMARY OF THE INVENTION

A comb-line filter is provided with two notch resonator at each end to enhance the selectivity of the filter. The dual notching resonators are mutually coupled to the first bandpass resonator at each of the comb-line and the two end bandpass resonators are coupled via a plurality of bandpass resonators offset from the center running the length of the ground planes. A shield is positioned between each pair of notching resonators to prevent cross coupling therebetween. The shield is on alignment with the adjacent bandpass resonator so that mutual coupling between the bandpass resonator and each of the notch resonators is achieved.

DETAILED DESCRIPTION OF THE INVENTION

Figure 1:
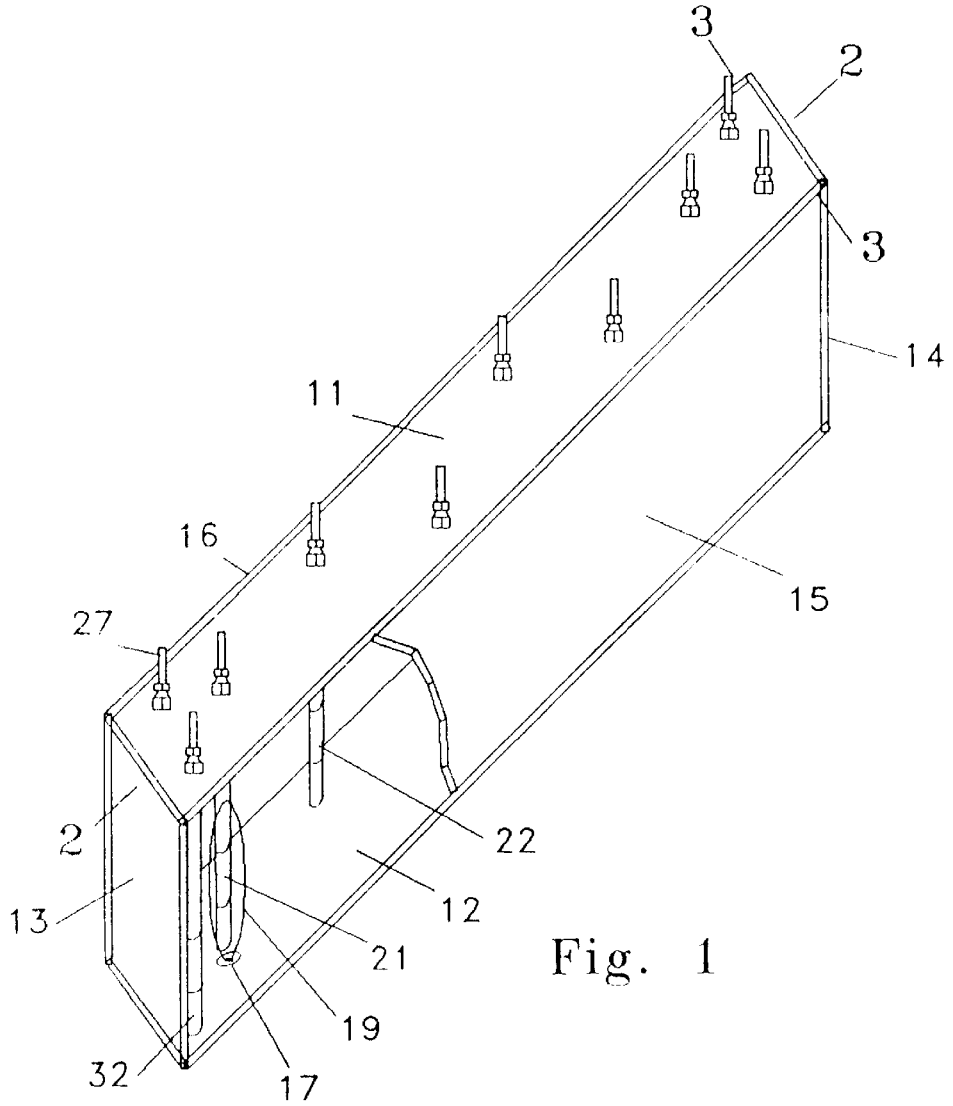
FIG. 1 is a three-quarter view of a preferred embodiment of the invention.
Figure 4:
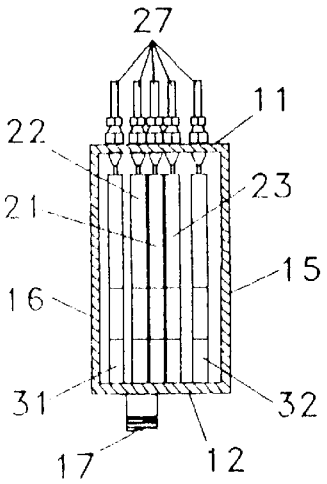
FIG. 4 is an end cut-away view of the preferred form of the invention as illustrated in FIG. 1 with the notch resonator shield removed for clarity.

The best mode for carrying out the invention comprises an elongated casing of electrically conductive material as illustrated by FIG. 1 with a plurality of resonator rods, 21–26, in a comb-line configuration, creating a coupling network between pairs of notch resonators. In the preferred embodiment the rods are beams having a circular cross section but the beams may have any desired or convenient cross section such as elliptical, rectangular or square for example. The casing is comprised of conductive ground planes 11 and 12 which are joined by conductive end plates 13 and 14. Conductive side walls, 15 and 16 complete the structure. Electrical signals are introduced and extracted from the comb-line filter by coaxial connectors 17 and 18 which function as input and output means via coupling loops such as 19 of FIG. 1 which is immediately adjacent to a bandpass resonator.

Figure 2:
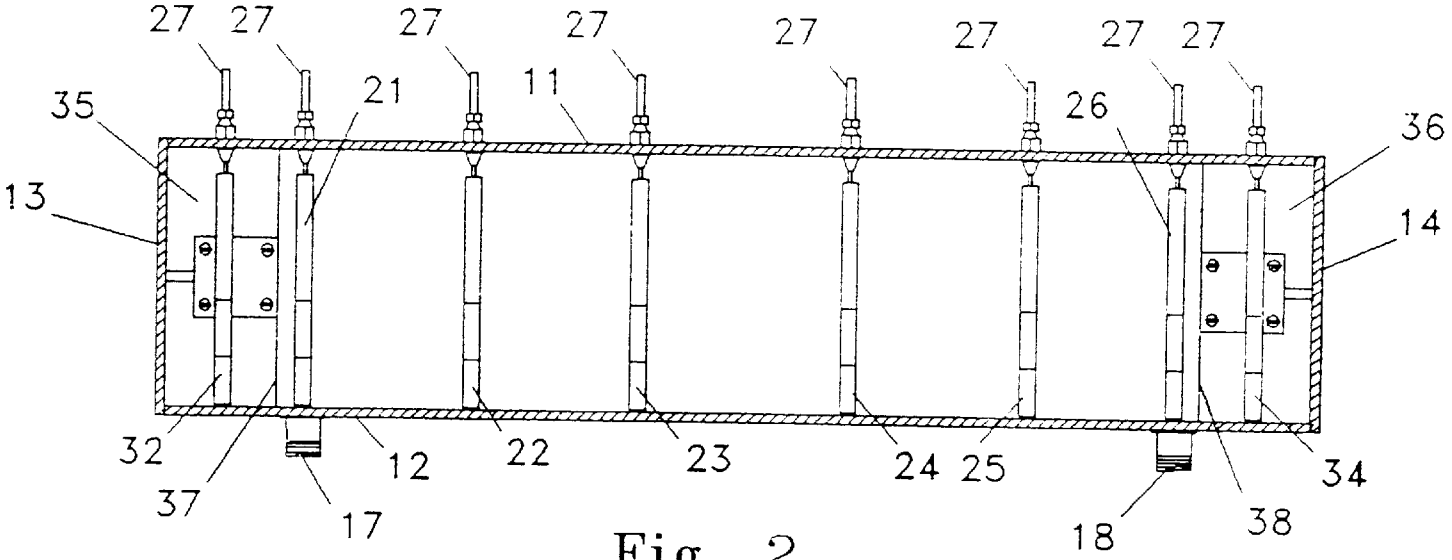
FIG. 2 is a side cut-away view of the preferred form of the invention as illustrated in FIG. 1.
Figure 3:
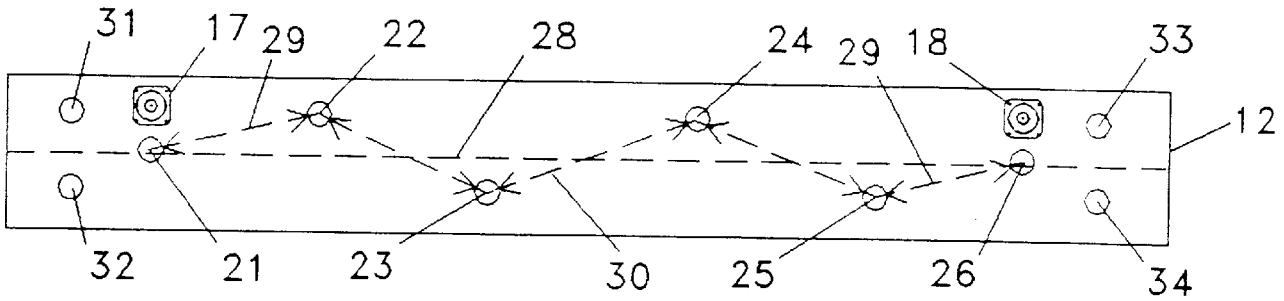
FIG. 3 is a top view of a preferred form of the invention illustrated in FIG. 1.

The comb-line bandpass resonators, 21 through 26, and notch resonators, 31 through 34, of FIGS. 2 and 3 are rods which include a tuning means 27 for adjusting the lump capacitance of the resonator and the electrical length of the rod between the conductive ground planes 11 and 12. The dual notch resonators at each end of the structure are comprised of a pair of rods similar to the bandpass resonators but due to location are coupled to the input and output bandpass resonators and function as notch filters. They are separated by resonator shields 35 and 36 which are electrically connected to adjacent end covers 13 and 14 and between the conductive ground planes 11 and 12 leaving unconnected edges 37 and 38 which are adjacent to the respective input or output bandpass filter resonator rod 21 or 26.

The bandpass resonators 21 through 26 form a comb-line filter with bandpass resonators 21 and 26 serving as input and output filter means electromagnetically coupled to the inductive loops 19 of their respective coaxial connectors 17 and 18. The bandpass resonators 22 through 25 are staggered on either side of the center line 28 as best seen in FIG. 3. They couple the input and output resonators 21 and 26 together at the passband frequency. They are staggered on opposite sides of the line 28 to shorten the physical length of the filter assembly while maintaining the preferred distance between resonator rods. In the preferred embodiment line 28 is a center line bisecting the filter cavity but it may be off-center or skewed, the controlling concept for this imaginary line is that it is a straight line passing through the unconnected edge 37 of notch resonator shield 35, its adjacent input/output bandpass resonator rod 21, the input/output bandpass resonator rod 26 and the unconnected edge 38 of its adjacent notch resonator shield 36.

The bandpass resonators are mounted to the narrow wall, 12, and the spacing between the mounting holes is graduated larger to smaller from center resonators 23 and 24 to the input/output resonators 21 and 26 at the opposite ends of the comb-line filter as best seen in FIG. 3. In this embodiment, it ranges from 0.178 wavelength, or 4.58 inches, line 30, to 0.142 wavelength, or 3.65 inches, lines 29, computed for air dielectric, which is the filter medium here. Further, by way of example, the spacing between resonators 22 and 23 and between resonators 24 and 25 may be 0.168 wavelength, or 4.34 inches. This spacing is a key factor in setting the bandpass width and flatness, and will change with any particular filter design, including the number and diameter of resonators. The exemplary embodiment, resonator diameter is 0.0146 wavelength in air, or about 0.375."

The bandpass resonators are 0.208 wavelength long, or 5.375" for this embodiment. The comb-line design is centered at approximately 458 Mhz, having a wavelength in air of 25.76".

The notch resonators 31 through 34 are also mounted to the narrow wall, 12, and spaced from the input/output resonator at each end of the comb-line by 0.083 wavelength in air, or 2.13", in all four cases, this spacing may also be altered to vary notch resonator coupling to the input/out bandpass resonator, and hence produce varying notch attenuation. In actuality, this spacing is experimentally adjusted to achieve the desired blending of bandpass and notch filter frequency response. The notch resonators are the same in diameter and length as the bandpass resonators in this embodiment.

As can best be seen in FIG. 3, the bandpass resonators 22 through 26 are not on the center line, 28, between the input/output resonators 21 and 26. They are staggered slightly to obtain the fringe field coupling desired in a physically shorter filter length. The spacing produces a nominal 4 Mhz wide bandpass at 458 Mhz and the filter response is adjustable over a range of about 10%, or plus or minus 23 Mhz.

The end bandpass resonators 21 and 26 are each coupled to a pair of individual notch resonators, bandpass resonator 21 to notch resonators 31 and 32 and bandpass resonator 26 to notch resonators 33 and 34. A shield, 35 or 36, is positioned between each pair of notch resonators to prevent cross coupling which would result in the loss of the ability to allow the individual notch frequencies to be adjusted for the most favorable addition to the comb-line bandpass response and to enhance the roll off immediately above and below the bandpass. In a preferred embodiment, the return loss is about −20 db in the center of the bandpass which equates to a 1.22:1 VSWR (voltage standing wave ratio), or an impedance variation of from 40.9 Ohms to 61 Ohms, with 50 Ohms producing the desired VSWR of 1.00:1. The ideal is approached by reducing the loss in the passband by adding adjustable capacitive coupling slugs between bandpass resonators.

Figure 5:
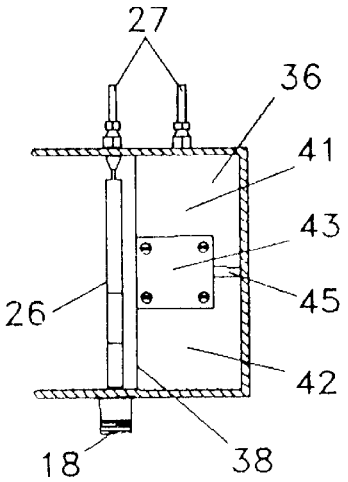
FIG. 5 is a detailed cut-away view illustrating the resonator shield taken along the lines 2—2 of FIG. 1.
Figure 6:
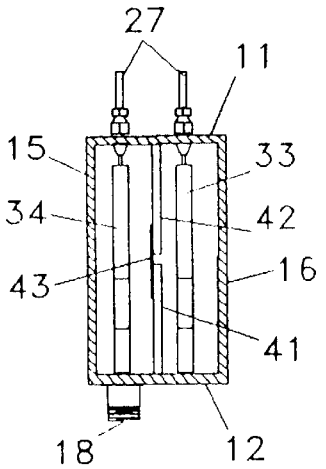
FIG. 6 is a detailed view of the resonator shield taken along the lines 3—3 of FIG. 1 with all but two notch resonator rods removed for clarity.

The basic element of the present invention is the means to mutually couple two notch resonators to the same bandpass filter resonator with the two notch resonators tuned to two different frequencies positioned close to the edge of the passband of the comb-line filter. This is accomplished by the shields, 35 and 36, positioned at each end of the comb-line structure. The shields are grounded to their respective end covers 13 or 14 and conductive ground planes 11 and 12 as illustrated by FIG. 5. Physically each shield is comprised of two conductive plates 41 and 42 joined by an electrically conductive member 43 to create a shield structure which includes an air gap 45. In a preferred embodiment the air gap is adjacent to the end cover. Notch resonators 31 and 32 or 33 and 34 are positioned on either side of the shield and set back from the edge of the shield facing the bandpass resonator 21 or 27 to minimize the intermingling of the notch resonator currents. The detrimental effects of the intermingling or cross coupling of the resonator currents is further reduced by proper selection of the notch resonator frequencies. The physical proximity of the notch resonators 31 and 32 or 33 and 34 to the bandpass resonator 21 or 27 determines the amount of mutual coupling therebetween and the depth and sharpness of the notch. The shields, 35 and 36, between the notch resonators are constructed so as to not inhibit the mutual coupling of the notch resonators to the adjacent bandpass resonator 21 or 26. The setback of the notch resonators is only as far from the adjacent bandpass resonator as will result in a minimal degradation of the basic comb-line selectivity when the notch is tuned close to the edge of the passband. Since the notch resonators are stagger tuned, it is preferable to tune one notch resonator close to the passband frequency to increase the notch depth and width and then tune the companion notch to be further from the passband frequency. This will enhance the resultant selectivity by reducing response flyback.

The width of the shields 35 and 36 is determined by the most favorable combined notch resonator coupling to the bandpass filter resonator, and the reduction of notch resonator current interaction. The notch resonators are effectively in four-sided enclosures with one side removed and positioned within the basic comb-line filter structure to obtain the desired mutual coupling to the first bandpass resonator at each end of the comb-line.

Figure 7:
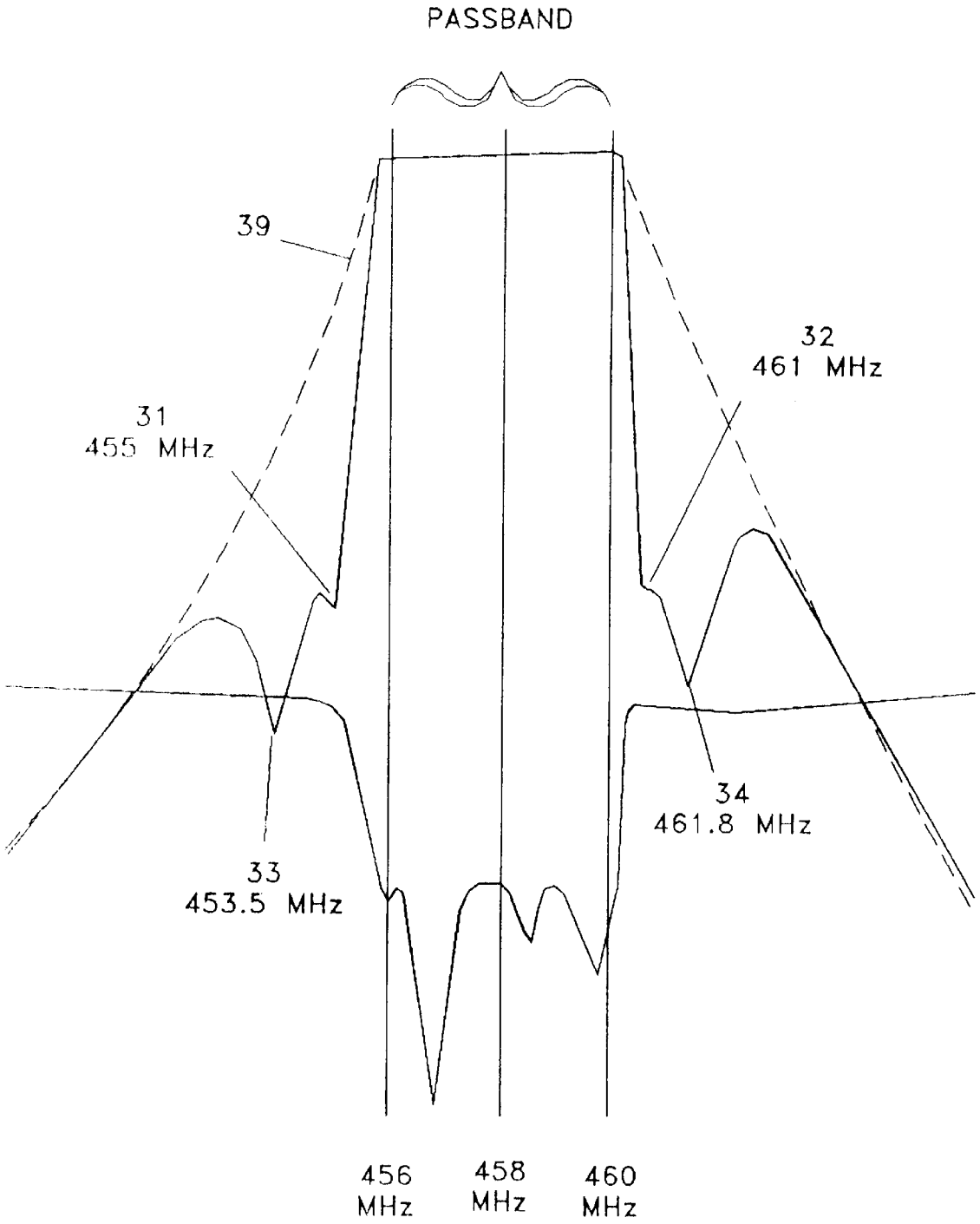
FIG. 7 presents the response curve of a preferred form of the embodiment.

The response curve of the preferred embodiment is illustrated in FIG. 7 which depicts how the notch resonator tuning is chosen to prevent the resonator currents of the notch resonators, located either side of a shield, from intermingling and destroying the independent tuning ability of each notch response curve.

For instance, on the response curve notch 31 is tuned by notch resonator 31, notch resonator 32 tunes notch 32, notch resonator 33 tunes notch 33 and notch 34 tunes notch 34. If you compare the physical location of the notch resonators 31, 32, 33 and 34 in FIG. 3 you will note that the notch frequencies which are adjacent to one another, 31 and 33 and 32 and 34, have their resonators located at opposite ends of the comb-line filter. The "Q" of the notch resonators is sufficiently high so that physically adjacent resonators will have widely separated resonant frequencies and currents, allowing tuning of the individual notch resonators for the best overall selectivity. The dotted curve 39 illustrates what the selectivity of the comb-line filter would be without the notch resonators.

While preferred embodiments of this invention have been illustrated and described, variations and modifications may be apparent to those skilled in the art. Therefore, I do not wish to be limited thereto and ask that the scope and breadth of this invention be determined from the claims which follow rather than the above description.

What is claimed is:

1. A comb-line filter, comprising a first input/output bandpass resonator;

a second input/output bandpass resonator;

a coupling bandpass resonator positioned between said first and second input/output bandpass resonators;

a first notch resonator adjacent to and electromagnetically coupled directly to said first input/output bandpass resonator; and a second notch resonator adjacent to and electromagnetically coupled directly to said first input/output bandpass resonator.

2. A comb-line filter as defined by claim 1, further comprising a first notch resonator pair shield means incorporating an air gap for electromagnetically shielding said first notch resonator from said second notch resonator.

3. A comb-line filter as defined by claim 2, comprising:

a third notch resonator adjacent to and electromagnetically coupled to said second input/output bandpass resonator;

a fourth notch resonator adjacent to and electromagnetically coupled to said second input/output bandpass resonator; and a second notch resonator pair shield means for electromagnetically shielding said third input notch resonator from said fourth notch resonator.

4. A comb-line filter as defined by claim 3, wherein said first and second notch resonators are stagger tuned on one side of a passband frequency of said comb-line filter and said third and fourth notch resonators are stagger tuned on the other side of said passband frequency of said comb-line filter.

5. A comb-line filter as defined by claim 4, wherein said notch, input/output bandpass and coupling bandpass resonators have a physical length which is electrically less than a quarter-wave length at the passband frequency of said comb-line filter.

6. A comb-line filter as defined by claim 5, including a center equidistant from said input/output bandpass resonators wherein said input/output bandpass and coupling bandpass resonators comprise rod structures which have a physical spacing graduated larger to smaller from said center to said input/output bandpass resonators.

7. A comb-line filter as defined by claim 6, comprising:

a first conductive ground plane;

a second conductive ground plane;

said notch, input/output bandpass and coupling bandpass resonators each comprise a beam structure arranged perpendicularly to and supported between said first conductive ground plane and said second conductive ground plane; and first and second conductive end covers which each lie in planes parallel to said beam structures and are electrically connected each between opposite adjacent ends of said first and second conductive ground planes forming a box structure therefrom.

8. A comb-line filter as defined by claim 7, wherein said first and second notch resonator pair shield means are each include at least four edges including an unconnected edge adjacent to a pair of opposite edges electrically connected to said first and second conductive ground planes and a fourth edge opposite said unconnected edge and electrically connected to a different one of said first and second end covers and oriented in a plane perpendicular to said first and second conductive ground planes;

said unconnected edges each positioned mutually exclusively adjacent to one of said input/output bandpass resonators and aligned along a line passing through said input/output bandpass resonators; and a plurality of said coupling bandpass resonators arranged on alternate sides of said line.

9. A comb-line filter as defined by claim 8, wherein said first and second notch resonator pair shield means are each comprised of first and second conductive plates joined by a conductive means dimensioned to leave a gap between said plates, further comprising:

a separate input cable connecting loop assembly means electromagnetically coupled to each of said input/output resonators.

10. A comb-line filter, comprising:

an elongated electrically conductive case including a pair of end covers physically and electrically connected to four side members for forming a box;

a conductive plate in each end of said box for creating a pair of resonant cavities in each end of said box comprised of one of said conductive plates, one of said end covers and three of said four side members, each of said resonant cavities having an open side defined by an unconnected edge of said conductive plate facing said resonant cavities at the other end of said box;

an adjustable resonator in each of said resonant cavities for forming notch resonators therefrom;

an input/output means positioned adjacent to the open sides of said resonant cavities at each end of said box;

said input/output means each including a single resonator adjacent to said unconnected edge of said adjacent conductive plate and aligned with the longitudinal axis of said adjacent conductive plate for effecting a bandpass filter electromagnetically coupled to each of said adjacent notch resonators; and means for electromagnetically coupling said resonators of said input/output means together.

11. A filter, comprising:

a bandpass resonator;

a first notch resonator adjacent to and electromagnetically coupled to said bandpass resonator;

a second notch resonator adjacent to and electromagnetically coupled to said bandpass resonator;

means for electromagnetically shielding said first notch resonator from said second notch resonator;

a third notch resonator;

a fourth notch resonator;

means for electromagnetically coupling said third and fourth notch resonators to said bandpass resonator;

means for electromagnetically shielding said third notch resonator from said fourth notch resonator;

said means for electromagnetically coupling said third and fourth notch resonators to said bandpass resonator comprises at least one coupling bandpass resonator;

said bandpass resonators are physically dimensioned to electrically provide a fractional wave length at a passband frequency of said filter and said notch resonators are physically dimensioned to electrically provide a fractional wave length at a desired notch frequency;

said coupling bandpass resonator comprises a plurality of individual coupling bandpass resonators, each comprising rod structures and said rod structures are spaced apart by graduated distances larger to smaller from a center coupling bandpass resonators to an output bandpass resonators; and said notch resonators comprise rod structures.

12. A filter as defined by claim 11 wherein said first notch resonator is tuned closer to said bandpass resonator than said second notch resonator.

13. A filter as defined by claim 12, comprising:

a first conductive ground plane;

a second conductive ground plane;

said bandpass resonator rod structures and said notch resonator rod structures are arranged perpendicularly to and supported between said first conductive ground plane and said second conductive ground plane; and first and second conductive end covers which each lie in planes parallel to said bandpass resonator rod structures and said notch resonator rod structures and are electrically connected each between opposite adjacent ends of said first and second conductive ground planes forming a box structure therefrom.

14. A filter as defined by claim 13 wherein said means for electromagnetically shielding said first notch resonator from said second notch resonator and said third notch resonator from said fourth notch resonator are conductive plates, each including one unconnected edge and three edges electrically connected to said first and second conductive ground planes and a different one of said first and second end covers;

said conductive plate means for shielding said notch resonators are positioned with their unconnected edges aligned along a line passing through said bandpass resonator rods of the bandpass resonators immediately adjacent to said first and second and said third and fourth notch resonators; and the remaining ones of said coupling bandpass resonators are spaced apart and arranged on alternate sides of said line.

15. A filter as defined by claim 14 wherein said conductive plate means for shielding said notch resonators are each comprises of first and second conductive plates joined by a conductive means dimensioned to leave a gap between said plates.

16. A filter as defined by claim 15, further comprising an input cable connecting loop assembly electrically coupled to a rod comprising said bandpass resonator rod and an output cable connecting loop assembly electrically coupled to said coupling bandpass resonator closest to said third and fourth notch resonators.

* * * * *